United States Patent [19]

Jenkins et al.

[11] Patent Number: 4,615,508

[45] Date of Patent: Oct. 7, 1986

[54] APPARATUS FOR SKIDDING A LOAD ON A SUPPORT

[75] Inventors: Cecil Jenkins; Leroy K. Peaster, both of Tulsa; John C. Brittain, Sperry, all of Okla.

[73] Assignee: Lee C. Moore Corporation, Tulsa, Okla.

[21] Appl. No.: 668,633

[22] Filed: Nov. 5, 1984

[51] Int. Cl.[4] ..... B66F 1/00

[52] U.S. Cl. ..... 254/106

[58] Field of Search ..... 254/105, 106, 107

[56] References Cited

U.S. PATENT DOCUMENTS 3,486,737 12/1969 Campbell ..... 254/106

3,559,954 2/1971 Chambers et al. ..... 254/106

*Primary Examiner*—Robert C. Watson

*Attorney, Agent, or Firm*—Laney, Dougherty, Hessin, Claro & Beavers

[57] ABSTRACT

Apparatus for skidding a drilling rig of the type having a roller mechanism which includes at least one roller for non-rotatingly supporting at least some of the rig on a platform and at least one roller for rotatingly supporting at least some of the rig while it is skidded. The drilling rig platform is supported by beams having a vertical web mounted below each non-rotating roller. The web is in vertical alignment with the vertical axis of its associated non-rotating roller. A beam having a vertical web is mounted beneath the rig above each rotating roller. The rig beam web is in vertical alignment with the vertical axis of its associated rotating roller.

12 Claims, 10 Drawing Figures

APPARATUS FOR SKIDDING A LOAD ON A SUPPORT

BACKGROUND AND SUMMARY OF THE INVENTION

The instant invention pertains to apparatus for skidding a load on a support and more particularly to such apparatus which incorporate rollers to support at least part of the load to facilitate skidding.

When it is desired to move a load on a support, for example a well-drilling rig on a platform, the load can simply be skidded across the support. In the case of a drilling rig, this is conventionally achieved by the use of hydraulic cylinders and pistons which may be connected to the rig and to selected points on the platform to slide the rig along the platform. U.S. Pat. No. 3,486,737 to Campbell, assigned to the assignee of the instant application, discloses an apparatus for skidding a load on a support. In Campbell, an hydraulic ram has its cylinder end connected to a drilling rig and its rod connected to a roller which is positioned beneath the rig. A friction-actuated lifting device is operable between the roller and the platform floor to lift the roller as the ram extends. Such lifting transfers at least part of the load to the roller to facilitate skidding of the rig.

The design disclosed in the Campbell patent represents a clear advance over prior art at the time. Subsequent to Campbell, further improvements in skidding apparatus were made in which the friction-actuated lifting device was replaced with a pair of lifting rollers which operate on a cam surface. A skidding roller, which serves the same function as the roller in Campbell, is sandwiched between the lifting rollers and all of the rollers are rotatable about a common axis. As the outer roller pair is forced up a cam surface by means of an hydraulic ram, at least some of the weight of the rig is shifted to the middle roller to facilitate rig skidding.

The roller skidding method and apparatus subsequent to Campbell suffers from drawbacks which are related to the structure of the typical platform upon which a drilling rig is to be skidded. The usual platform includes a pair of I-beams known as capping beams, each of which has a vertical web between upper and lower horizontal flanges. A skidding apparatus is positioned beneath each side of the rig over each capping beam. The skidding apparatus, and hence the weight of the rig, is supported by the top flange of the capping beams. The lifting rollers load the capping beam along its outer flange edges which is the least desirable way of loading a beam, the most desirable being loading at the center of the flange over the web. In some instances, the flange of the capping beam is so narrow that the lifting rollers extend over the edges of the capping beam flange thereby preventing its use due to potential instability.

Proper loading of the capping beam has become more important in that rigs weighing as much as a million pounds may be skidded on a platform.

The instant invention comprises an improved method and apparatus which includes, for each lifting roller, a support beam therebeneath having its vertical web in alignment with the vertical axis of the roller. For each skidding roller, a load beam having a vertical web is mounted on the underside of the load. To transmit the weight of the load to the skidding roller the load beam web is in vertical alignment with the vertical axis of the skidding roller. As the rig is skidded, the vertical axes of the rollers are maintained in alignment with the vertical axes of each roller's associated web.

It is an advantage of the instant invention to provide an improved method and apparatus for skidding a load on a support which optimally loads I-beams in the support and on the underside of the load.

It is another advantage of the instant invention to provide such an apparatus which may be utilized with support I-beams having a narrow flange.

These and other advantages of the instant invention will become more fully apparent as the following detailed description is read in view of the accompanying drawings wherein.

DETAILED DESCRIPTION OF THE PREFERRED EMBODIMENTS OF THE INVENTION

Figure 1:
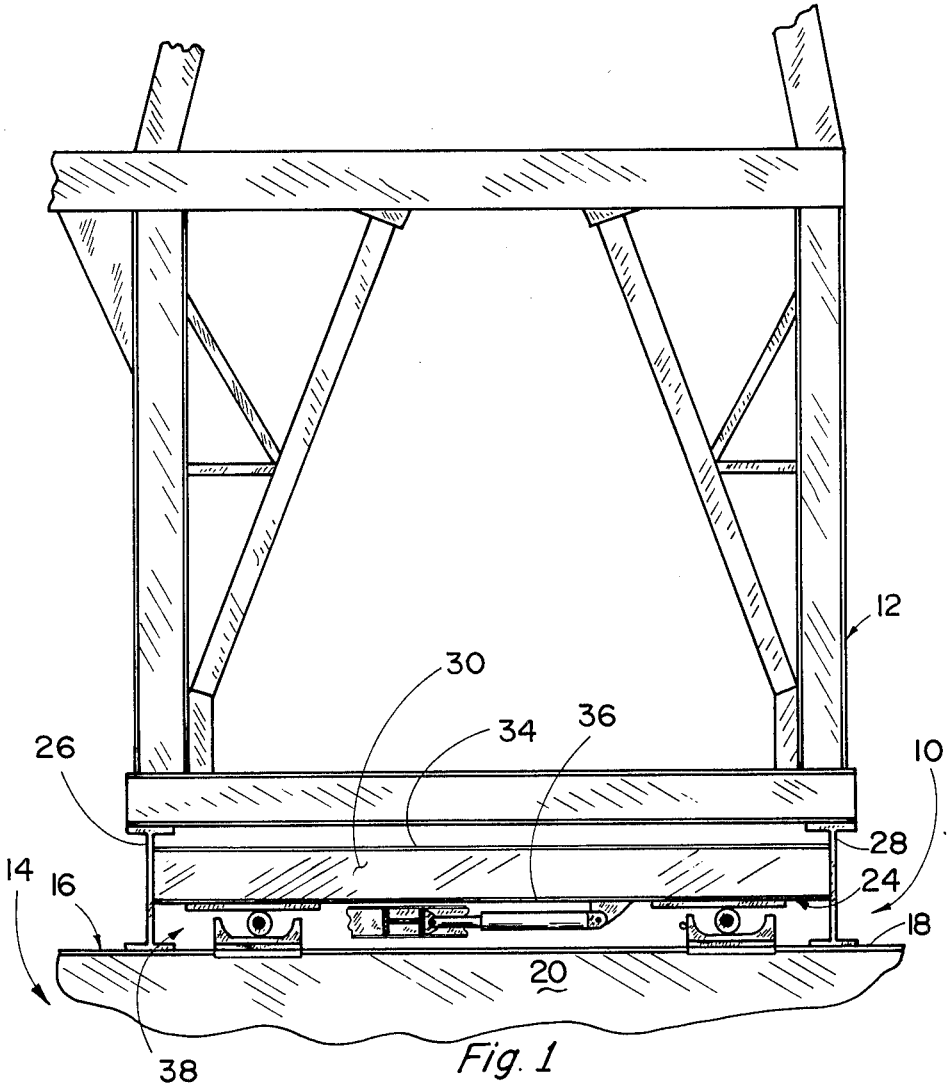
FIG. 1 is a partial side view of a drilling-rig base on a platform.

Turning now to the drawings, indicated generally at 10 in FIG. 1 is a portion of a skidding device constructed in accordance with the apparatus of the instant invention. Device 10 is positioned between a conventional drilling rig 12 and a platform, a portion of which is indicated generally at 14. Platform 14 includes an I-beam, or support beam, a portion of which is shown in FIG. 1, also known as a capping beam 16. Beam 16 includes an upper horizontal flange 18 and a vertical web 20 at the lower end of which is another flange 22 (in FIG. 4).

Included in device 10 is a load beam 24 which is supported by and fixedly mounted between a pair of I-beams 26, 28, the ends of which are viewable in FIG. 1. Rig 12 is supported upon beams 26, 28 which are in turn maintained in an upright spaced-apart position by beam 24 and by a corresponding beam (not visible) opposite beam 24. Beam 24 includes a pair of vertical webs 30, 32 which are sandwiched between upper and lower flanges 34, 36. Indicated generally at 38 is a roller mechanism. It should be noted that a second roller mechanism, which is substantially similar to mechanism 38, is located at the opposite end of beams 26, 28 beneath the beam opposite beam 24.

Figure 3:
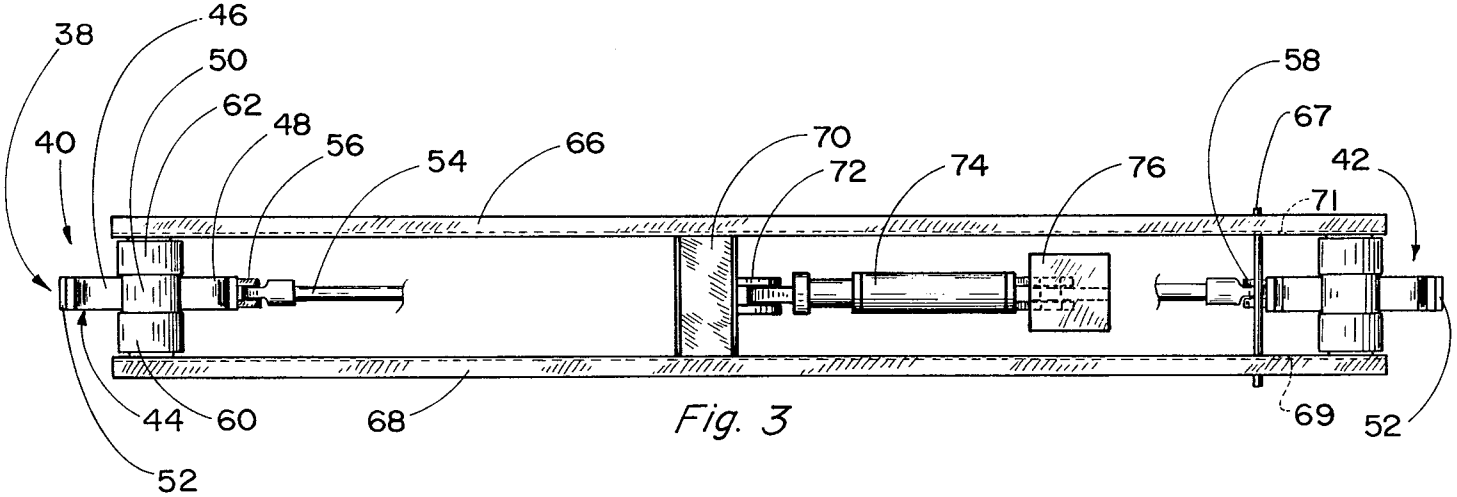
FIG. 3 is a view taken along line 3—3 in FIG. 2.
Figure 2:
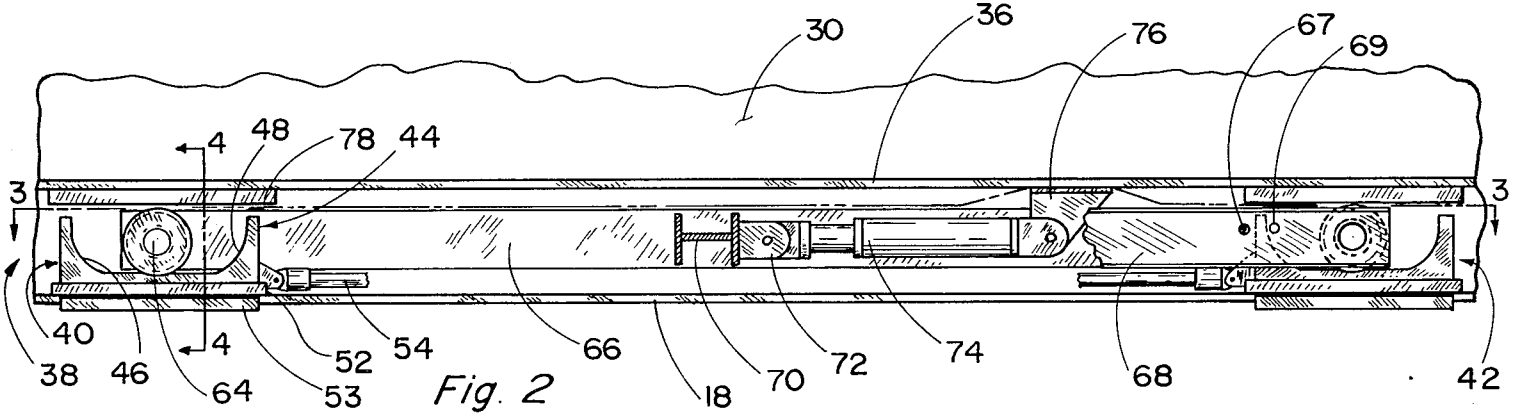
FIG. 2 is an enlarged fragmentary side view.

For a more detailed view of roller mechanism 38, attention is directed to FIGS. 2 and 3. Included in roller mechanism 38 is a pair of shoe-and-roller units 40, 42. Units 40, 42 are substantially identical to one another so a description will be made only of unit 40. Included in unit 40 is a shoe 44. Shoe 44 includes cam surfaces 46, 48 upon which a roller 50 may roll. Roller 50 is referred to herein as a first or nonrotating roller. Shoe 44 is fixedly mounted on a substantially planar plate 52 which in turn rests upon flange 18 of capping beam 16. Brackets 53, 55 (both shown in FIG. 4) extend downwardly from the bottom of plate 52 on either side of flange 18. Units 40, 42 are linked together via a rod 54 and connectors 56, 58 for synchronous movement along the longitudinal axis of rod 54 as will later be more fully explained.

Shoe-and-roller unit 40 further includes rollers 60, 62 referred to herein as rotating or second and third rollers. Each of rollers 50, 60, 62 are concentrically mounted on a common axle 64. As can be seen, rollers 60, 62 are of a slightly larger diameter than roller 50. The axle is journaled for rotation between frame members 66, 68. As has been mentioned, shoe-and-roller unit 42 is substantially identical to shoe-and-roller 40 and includes a similar axle which is likewise journaled between frame members 66, 68. A rod 67 is received through opposed holes in members 66, 68. A pair of similar opposed holes 69, 71 permit the rod to be received therethrough. The function of rod 67 will be later described.

Fixedly mounted between members 66, 68 is a beam 70. Beam 70 provides support for a connector 72 which secures the piston end of a ram 74 to the beam. The other end of the ram is pinned in a conventional manner to a plate 76 which is fixedly mounted on the underside of flange 36, the lower flange of load beam 24.

Figure 4:
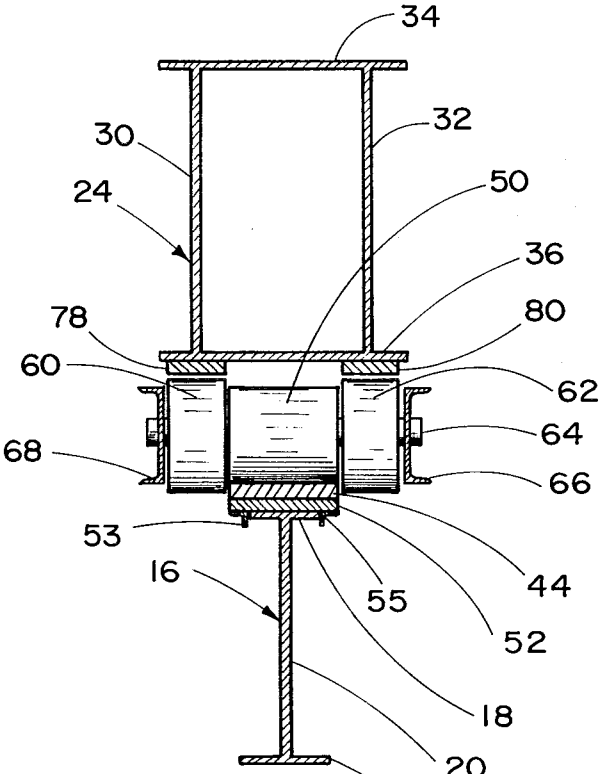
FIG. 4 is a view taken along line 4—4 in FIG. 2.
Figures 6, 7, 8, 9, 10:
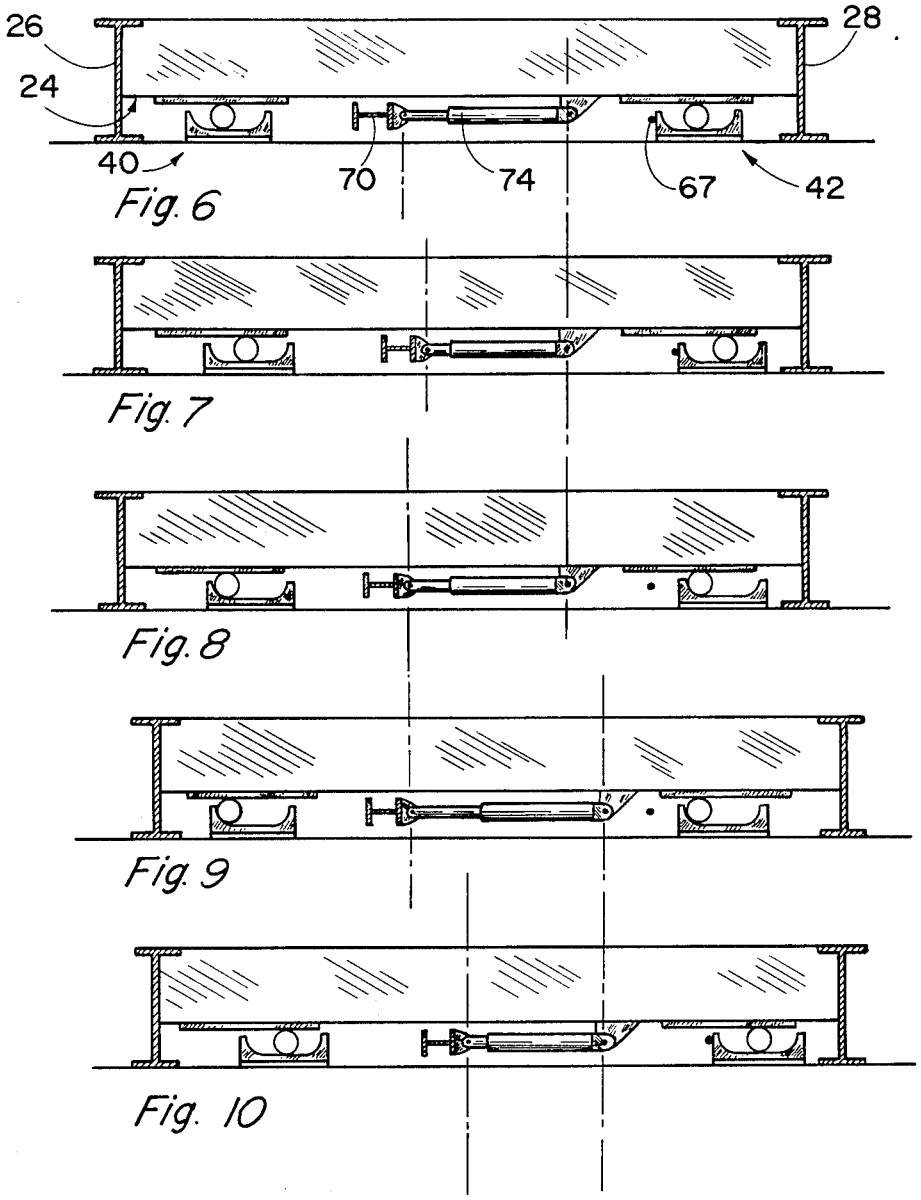
FIGS. 6–10 are somewhat schematic representations of the view shown in FIG. 2 depicting sequential movement of the apparatus of the invention.

In FIG. 4, a pair of wear plates 78, 80 are fixedly mounted on the underside of flange 36 beneath webs 30, 32 and above rollers 60, 62. The wear plates extend along the underside of flange 36 in the vicinity of the rollers as shown in FIG. 1.

Figure 5:
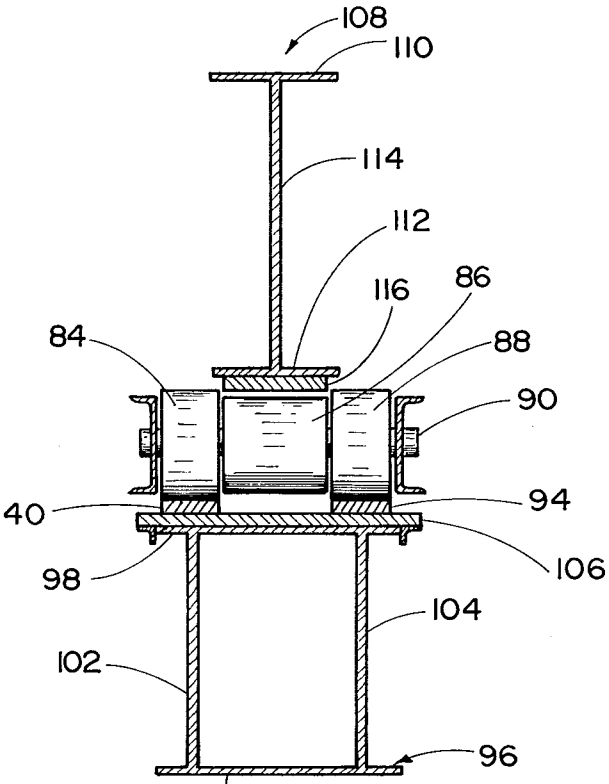
FIG. 5 is a view similar to FIG. 4 of an alternative embodiment of the invention.

Considering now the structure of a slightly different embodiment of the invention, attention is directed to FIG. 5. Included therein are three rollers 84, 86, 88 which are concentrically mounted on an axle 90. Roller 86 is referred to herein as a rotating roller. Rollers 84, 88 are, such being referred to herein as nonrotating rollers, each received within a shoe 92, 94 respectively. Shoes 92, 94 are shaped like shoe 44 in FIG. 2. The rollers and shoes 92, 94 in FIG. 5 comprise a shoe-and-roller unit which serves a similar function to the shoe-and-roller units of the previously-described embodiment. A support beam 96 includes upper and lower flanges 98, 100 having a pair of vertical webs 102, 104 sandwiched therebetween. Shoes 92, 94 are fixedly mounted on a plate 106 which is slidable along flange 98. A load beam 108 includes upper and lower flanges 110, 112, respectively and a vertical web 114. A wear plate 116 is fixedly mounted on the underside of flange 112. Other structure in FIG. 5 which is similar to that in FIG. 4 is not identified but serves functions similar to those identified in FIG. 4.

It is to be appreciated that in the embodiment shown in FIG. 5, a second shoe-and-roller unit as well as frame members, like members 66, 68, and a ram, like ram 74 are provided as in the embodiment shown in FIGS. 1–4.

Attention is now directed to FIGS. 6–10 for a description of the manner in which the method and apparatus of the embodiment of the invention shown in FIGS. 1–4 operates. In the initial condition in FIG. 6, ram 74 is partially extended and pin 67 is received through the aligned holes of frame members 66, 68 to the left of unit 42. Fluid is introduced into ram 74 to position the ram in its fully contracted position. When the ram moves from the position in FIG. 6 to that of FIG. 7, action on members 66, 68 through beam 70 moves pin 67 to the right by an amount equal to the distance of ram contraction. Such movement of pin 67 pushes unit 42 to the right which, through pulling on rod 54, pulls unit 40 by the same distance to the right. Thereafter, fluid is injected into the ram to cause it to extend, the ram being shown partially extended in FIG. 8. As the ram extends, frame members 66, 68 are moved to the left thus rolling each roller in its shoe to the left and up the incline. Considering unit 40, when roller 50 moves upwardly, rollers 60, 62 in FIG. 4, contact wear plates 78, 80 on the underside of load beam 24 thus lifting at least a part of the load on the beam. Continued ram extension, from the position shown in FIG. 8 to that shown in FIG. 9, moves beam 24, and hence the rig, to the right. During such rightward movement, beam 24 is at least in part supported by rollers 60, 62 which rotate during movement. After the ram is fully extended, shown in FIG. 9, it is again fully contracted, shown in FIG. 10, which contraction moves shoe units 40, 42 rightwardly as in the movement between FIG. 6 and FIG. 7. As can be seen by comparing the relative positions of the apparatus in FIG. 6 and FIG. 10, rightward movement has occurred. Such continued contraction and extension of ram 74 will continue rightward movement of the rig for so long as is necessary or desired. It is to be appreciated that the ram in the other skidding apparatus, located at the opposite ends of beams 26, 28, is operated synchronously with ram 74 to enable both sides of the rig to be advanced equally.

Leftward movement of the rig may be achieved by placing pin 67 through holes 69, 71 in FIG. 2. Contraction and extension of the ram when pin 67 is received through members 66, 68 in holes 69, 71 moves the rig to the left.

Operation of the embodiment shown in FIG. 5 is essentially the same as that for the previously-described operation. However, it can be seen in FIG. 5 that outer rollers 84, 88 bear downwardly on their associated shoes while the load is lifted by and rolled along middle roller 86.

It is to be appreciated that modifications may be made to the above-described embodiments of the invention without departing from the spirit thereof which is described in the following claims.

We claim:

1. In skidding apparatus of the type having a roller mechanism which includes at least one lifting roller for nonrotatingly supporting at least some of a load on a support and at least one skidding roller for rotatingly supporting at least some of the load while it is skidded:

a support beam having a vertical web mounted on said support below each lifting roller, said web being in substantially vertical alignment with the vertical axis of its associated lifting roller; and a load beam having a vertical web below said load above each skidding roller, said load beam web being in substantial vertical alignment with the vertical axis of its associated skidding roller.

2. The apparatus of claim 1 wherein said apparatus includes only one lifting roller.

3. The apparatus of claim 2 wherein said apparatus includes only two skidding rollers.

4. The apparatus of claim 3 wherein said skidding rollers and said lifting roller having their horizontal axes substantially aligned.

5. The apparatus of claim 1 wherein said apparatus includes only two lifting rollers.

6. The apparatus of claim 5 wherein said apparatus includes only one skidding roller.

7. The apparatus of claim 6 wherein said skidding roller and said lifting rollers have their horizontal axes substantially aligned.

8. The apparatus of claim 1 wherein said support beam web is at a substantially 90° angle to the horizontal axis of its associated lifting roller.

9. The apparatus of claim 1 wherein said load beam web is at a substantially 90° angle to the horizontal axis of its associated skidding roller.

10. A load skidding apparatus for use on a support having a support beam which includes a vertical web comprising:

a frame;

a first roller mounted on said frame above said support beam and having its vertical axis in substantial vertical alignment with the vertical axis of said support beam web;

a second roller mounted on said frame on one side of first said roller;

a third roller mounted on said frame on the other side of said first roller; and support means positioned below the load above said rollers, said support means including:

a first vertical web having the vertical axis thereof in substantial vertical alignment with said second roller; and a second vertical web having the vertical axis thereof in substantial vertical alignment with said third roller.

11. The apparatus of claim 10 wherein said second and third roller axes are in substantial alignment with one another.

12. The apparatus of claim 10 wherein said first, second, and third roller axes are in substantial alignment with one another.

* * * * *